United States Patent [19]

Daly et al.

[11] 4,241,845

[45] Dec. 30, 1980

[54] RADIATOR CAPS

[75] Inventors: Andrew S. Daly, Ivanhoe; Peter R. May, Springvale South; George E. Braines, East Preston, all of Australia

[73] Assignee: A.S. Daly Nominees Pty. Ltd., Fairfield, Australia

[21] Appl. No.: 54,173

[22] Filed: Jul. 2, 1979

[30] Foreign Application Priority Data

Sep. 15, 1978 [AU] Australia ..... PD5972

[51] Int. Cl.[3] ..... B65D 51/16; B65D 53/02

[52] U.S. Cl. ..... 220/203; 220/303; 220/304; 220/DIG. 32

[58] Field of Search ..... 220/203, 303, 304, DIG. 32, 220/293, 295, 298, 301

[56] References Cited

U.S. PATENT DOCUMENTS

| | | | |
|---|---|---|---|
| 2,147,727 | 2/1939 | White et al. | 220/203 |
| 3,053,408 | 9/1962 | Rodgers | 220/203 |
| 3,071,285 | 1/1963 | Friend | 220/203 |
| 3,127,049 | 3/1964 | Welty et al. | 220/301 |
| 3,338,455 | 8/1967 | Miller | 220/DIG. 32 |
| 3,802,923 | 4/1974 | Spanur | 220/209 X |

*Primary Examiner*—Allan N. Shoap

*Attorney, Agent, or Firm*—Price, Heneveld, Huizenga & Cooper

[57] ABSTRACT

Automobile radiator cap assembly particularly suited to automobiles with coolant recovery systems in which coolant is blown through a venting duct in radiator filler neck. The cap assembly comprises a cap to fit over the upper end of the filler neck, a spring loaded primary element to seal against a ledge at the bottom of the filler neck, and a secondary sealing element having a cylindrical skirt portion extending internally within the filler neck and an annular flange portion projecting between the rim of the filler neck and the cap. A circumferential bead on the skirt engages the wall of the filler neck to provide a circumferential seal within the filler neck above the vent passage and the annular flange is clamped against the rim of the filler neck to provide a further seal.

11 Claims, 6 Drawing Figures

RADIATOR CAPS

BACKGROUND OF THE INVENTION

This invention relates to cooling systems of internal combustion engines and more particularly to the radiator caps fitted to the coolant radiators of such engines.

The engines of modern automobiles generally use high pressure cooling systems requiring effective sealing of the radiator cap to prevent loss of coolant during normal operation of the engine. The radiator caps are normally fitted with spring-loaded washer-type seals which bear down on a ledge surrounding the bottom opening of the radiator filler neck so that when the cap is fitted to the filler neck the loading spring serves to hold the cap firmly in position and to provide the loading force for a spring-loaded seal around the filler opening. During normal operation of the engine this seal is sufficient to prevent escape of coolant but if for any reason the pressure within the radiator becomes excessively hot coolant is "blown" through the seal to escape through an overflow of venting duct through the side of the filler neck.

There is also an increasing use of coolant recovery systems in which coolant blown through the venting duct is collected in a bottle or other receptacle containing a reserve of liquid coolant and when the radiator cools coolant is drawn back into the radiator through the vent duct and the filler neck. This requires the radiator cap to be fitted with a suction operated valve within the main washer type valve seal, the suction operated valve being normally closed under the influence of a spring and/or pressure in the radiator but opening when the radiator pressure falls a determined amount below atmospheric pressure to permit reverse flow of coolant. The connection of the radiator cap to the upper part of the filler neck must also be adequately sealed to prevent loss of vacuum by ingress of atmospheric air. At present this additional sealing is achieved by fitting the radiator cap with a flat annular sealing element which bears down on the upper rim of the filler neck. It has been found however that such flat annular sealing elements do not always provide an adequate seal. Moreover, when the cap is rotated for release both the lower and upper seals are immediately broken and coolant may then be sprayed out under radiator pressure even in cases where safety stops are fitted to enable the cap to be rotated initially to a partially opened or venting position before it is removed. The present invention provides a radiator cap fitted with a novel type of sealing means which greatly alleviates these problems.

SUMMARY OF THE INVENTION

According to the invention there is provided a radiator cap assembly for fitting to a radiator filler neck having a tubular side wall and an internally projecting, upwardly facing, annular ledge positioned at the bottom of the side wall and surrounding a filler opening, said assembly comprising:

a cap to fit over the upper end of the filler neck;

an annular first seal element;

seal mounting means mounting said first annular seal element from the cap so as to engage the ledge of the filler neck when the cap is fitted to the filler neck and including biasing means to load the sealing member against the ledge so as to form a primary seal; and a second seal element having a cylindrical skirt portion extending away from the cap so as to project within the side wall of the filler neck, an annular flange portion projecting outwardly from the cap end of the skirt portion, a first annular seal surface on the annular flange portion to engage the rim of the filler neck at the upper end of said side wall and a second annular seal surface on said skirt portion to engage the inner peripheral surface of the side wall of the filler neck and thereby form a circumferential seal around that wall when the cap is fitted to the filler neck.

The assembly of the present invention is particularly applicable for use with filler neck of the type which has a coolant venting duct extending from a port in the side wall of the filler neck to vent hot coolant which may escape through the primary seal and in this case the second annular seal surface of said second seal element is preferably disposed so as to form said circumferential seal above the level of the vent port. This arrangement may be used with radiators fitted with a coolant recovery system whereby the vented hot coolant is caught in a closed receptacle and is subsequently drawn back through the filler neck by suction generated in the radiator when the temperature of the coolant decreases. In this case it is preferred that the mounting means for the first annular seal element should comprise an annular member which is spring loaded away from the cap and is fitted with said first seal element and which carries a central one-way, suction-opened valve for flow of recovered coolant to the filler opening through said annular member but to seal against a reverse flow of pressurized coolant.

The invention also provides, the combination of a radiator filler neck having a tubular side wall and an internally projecting, upwardly facing, annular ledge positioned at the bottom of the side wall and surrounding a filler opening AND radiator cap assembly comprising:

a cap to fit over the upper end of the filler neck;

an annular first seal element;

seal mounting means mounting said first annular seal element from the cap so as to engage the ledge of the filler neck when the cap is fitted to the filler neck and including biasing means to load the sealing member against the ledge so as to form a primary seal; and a second seal element having a cylindrical skirt portion extending from the cap so as to project within the side wall of the filler neck, an annular flange portion projecting outwardly from the cap end of the skirt portion, a first annular seal surface on the annular flange portion to engage the rim of the filler neck at the upper end of said side wall and a second annular seal surface on said skirt portion to engage the inner peripheral surface of the side wall of the filler neck and thereby form a circumferential seal around that wall when the cap is fitted to the filler neck.

Preferably, said second annular seal surface of the second seal element is defined by an outwardly projecting circumferential bead on said skirt portion of that element.

Preferably, further said first annular seal surface of the second seal element is defined by a groove in the face of the flange portion adjacent the junction between the flange portion and skirt portion.

BRIEF DESCRIPTION OF THE DRAWINGS

In order that the invention may be more fully explained one particular embodiment will be described in detail with reference to the accompanying drawings in which:

FIGS. 1 to 5 illustrate a radiator cap assembly denoted generally as 11 and a radiator filler neck denoted generally as 12. The cap assembly 11 comprises a cap member 13 formed as a metal disc 14 having a downwardly depending outer peripheral skirt 15 and a pair of diametrically opposed lugs 16 turned inwardly from the lower edge of skirt 15. The central part of disc 14 is formed with a downwardly extending well portion 17 to which the upper end of a downwardly depending tubular stem 18 is connected by a rivet-type connection 19. A curved annular rib 21 is pressed in disc 14 to encircle the mouth of well 17 and the side or peripheral wall of the well is stepped to form a flat annular shoulder 22 immediately within rib 21.

Figure 1:
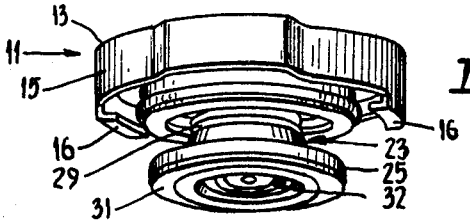
FIG. 1 is a perspective view of a radiator cap assembly constructed in accordance with the invention.
Figure 2:
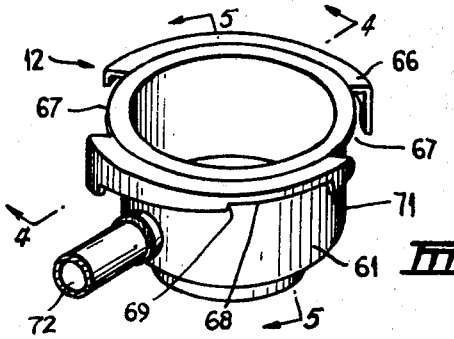
FIG. 2 is a perspective view of a radiator filler neck to receive the radiator cap assembly.
Figure 3:
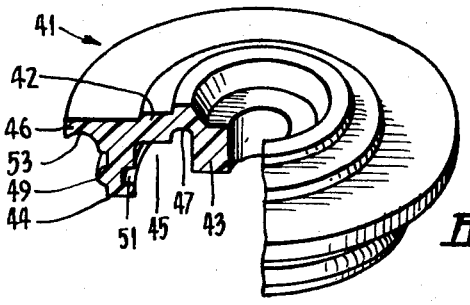
FIG. 3 is a broken-away perspective view of a moulded rubber sealing element incorporated in the radiator cap assembly.

The lower end of stem 18 carries a plunger member 23 comprising inner metal shell 24 fitted into an outer metal shell 25 formed with a radially outwardly projecting annular bottom flange 26. The outer shell 25 has a central aperture 27 whereby plunger member 23 is slidably fitted to stem 18 and the lower end of stem 18 has an out-turned flange 28 to serve as a stop against which member 23 is biased by a helical compression spring 29. An annular rubber sealing washer 31 is clamped between the inner an outer shells so as to overlay the underface of the annular flange 26 of the outer shell.

Plunger member 23 also carries a normally closed spring-loaded suction valve denoted generally as 32. This valve comprises a valve stem 33 slidable in an aperture 34 through the centre of inner shell 24, a valve disc 35 fixed to the bottom of stem 33, a rubber valve sealing gasket 36 overlaying valve disc 35 and a valve spring 37 which acts between the upper end of stem 33 and the upper part of inner shell 24 to bias the valve stem upwardly. The central part of inner shell 24 has one or more valve ports 38 surrounded by a downwardly projecting annular rib 39 which serves as a valve seat for the rubber sealing gasket 36. The operation of suction valve 32 will be described below.

In accordance with the present invention radiator cap assembly 11 is fitted with a specially shaped moulded rubber sealing element 41. This element comprises an upper disc portion 42 and, depending downwardly from the disc portion a central relatively thick annular boss portion 43 and a much thinner annular skirt portion 44. Skirt portion 44 is located near to the outer periphery of disc portion 42 so that there is an annular space 45 between the central boss portion 42 and the surrounding skirt portion 44 and so that disc portion 42 projects outwardly beyond skirt portion 44 to form an annular rim flange 46.

The central boss portion 43 of sealing member 41 fits tightly about stem 18 and the upper end of helical compression spring 29 fits snugly around that boss to engage a groove 47 in the underside of disc portion 42 so as to clamp the sealing member upwardly against the abutment provided by the shoulder 14 of the cap member. The upper face of seal member may be recessed to suit the well 17 of cap 13 and its outer part may be stepped and supported by a ribbed annular metal plate 48 sandwiched between the cap and the seal member.

The lower part of the skirt 44 of seal member 41 is formed with an external circumferential bead 49. This bead is of semi-circular cross-section and, as will be explained more fully below, it serves as a sealing element forming a circumferential seal around the internal peripheral surface of the filler neck when the cap assembly is fitted to the filler neck. Skirt 44 is also formed with an internal circumferential groove 51 immediately within the sealing bead 49 and this groove receives a spring steel circular expander clip 52.

A groove 53 is formed in the underface of the rim flange 46 at the junction of that face with the skirt portion 44, this groove merging with the skirt portion in a smoothly curved fillet.

Filler neck 12 is drawn and pressed from sheet metal. It is of tubular formation comprising a cylindrical side wall 61 at the bottom of which there is an internally projecting annular ledge 62 surrounding a bottom filler opening 63 defined by a spigot 64 which fits into the top of a radiator 65. At the upper end of side wall 61 there is an outwardly projecting circumferential flange 66 provided with a pair of diametrically opposed notches 67. When the radiator cap is fitted to the filler neck, its skirt lugs 16 are passed downwardly through notches 67 so that the radiator cap can then be rotated to move lugs 16 beneath the rim flange 66 of the filler neck. Rim flange 66 is formed with the usual ramp edges 68 to engage with lugs 16 and to draw the cap assembly downwardly as it is fitted to the filler neck. Ramp edges 68 are stepped at 69 to define a partially open or venting position and safety stops 71 are provided so that when the cap is rotated in the opening direction its lugs will initially engage the safety stops to halt the cap in the venting position and the cap must be pushed down firmly to over-ride the stops.

Filler neck 12 is provided with a vent duct or tube 72 extending from an opening or port 73 in the side wall 61 immediately above ledge 62. This tube is connected by flexible piping to a coolant recovery bottle (not shown).

Figure 6:
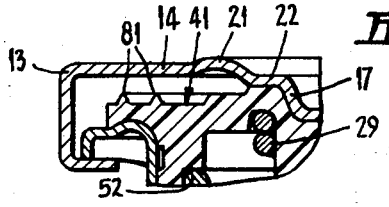
FIG. 6 is a vertical cross-section showing a radiator cap assembly having a slightly modified type of rubber sealing element.
Figure 4:
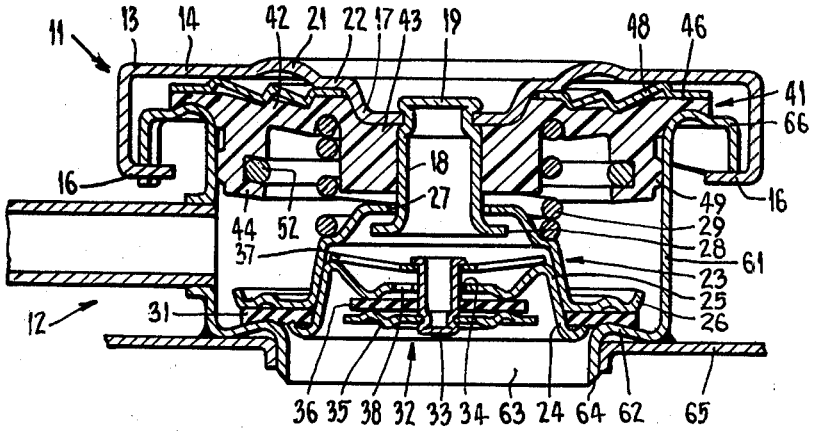
FIG. 4 is a vertical cross-section of the interfitted cap assembly and filler neck, the cross-section through the filler neck being generally on the line 4—4 in FIG. 2 and showing the cap assembly in its fully tightened position.

As the cap assembly 11 is fitted to the filler neck 12 the washer sealing element 31 of the cap assembly engages the ledge 62 of the filler neck and rotation of the cap to tighten it onto filler neck causes spring 29 to be compressed whereby the cap assembly is held firmly in position and the washer 31 forms a spring-loaded valve seal around the filler opening 63 as seen in FIG. 4. The upper sealing member 41 forms two additional seals in that its skirt 44 projects downwardly within side wall 61 so that the bead 49 forms a circumferential seal around the internal periphery of the filler neck and the groove 53 in the underface of rim flange 46 snugly engages the curved rim of the filler neck at the upper end of side wall 61. As also seen in FIG. 6, the mid-part of sealing member 41 is pressed firmly against the cap by the action of the spring and the flange 46 and support plate 48 are pressed upwardly by the filler neck rim until the outermost rib of the support plate is squashed against the underface of the cap. This promotes sealing between the seal member and the cap and produces a strong clamping force holding the grooved rim 46 of the sealing member against the rim of the filler neck.

During operation of the apparatus any coolant blown from the radiator through the spring-loaded valve seal 31 due to excess radiator pressure passes through vent pipe 72 to the recovery bottle. When the radiator subsequently cools the suction pressure so generated draws coolant from the recovery radiator back through pipe 72 and into the radiator via the central valve 32, the suction being sufficient to overcome the weak biasing force of valve spring 37 so as to draw the valve disc 35 and gasket 36 downwardly away from seating rib 39 to expose valve ports 38 to the radiator. The two additional seals provided by seal element 41 not only improve sealing against loss of pressurised coolant but they also ensure that atmospheric air cannot leak into the radiator between the cap and the filler neck when the radiator cools. Because of the snug fit of the sealing member groove 53 around the curved rim of the filler neck produces a very effective suction seal at that point. In fact the greater the suction applied, the closer is the curved surface of the sealing member drawn into engagement with filler neck rim. The central boss of seal element 41 can be a very tight fit on stem 18 so as to seal the central stem rivet connection with the cap against air leakage at that point.

Figure 5:
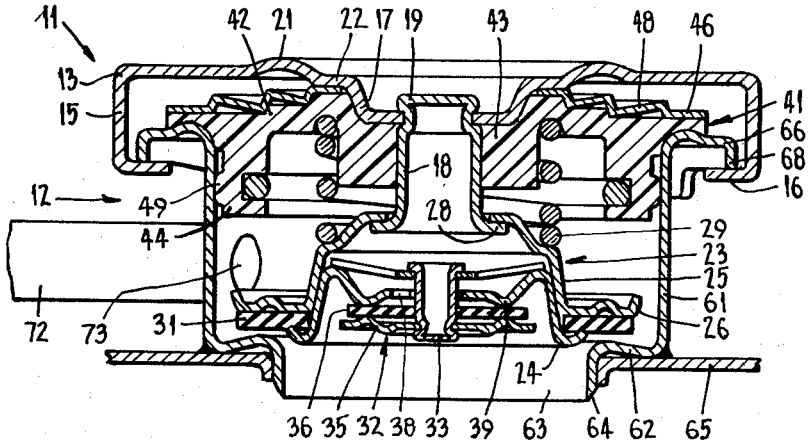
FIG. 5 is a further vertical cross-section through the interfitted cap assembly and filler neck, in this case the cross-section being taken through the filler neck generally on the line 5—5 in FIG. 2 and showing the cap assembly in partially released position.

When the cap is removed from the filler neck the circumferential seal formed by bead 49 is maintained after the primary seal provided by member 31 is broken so that the pressure in the radiator must be relieved by venting from vent pipe 72 before the cap is removed. This effect is illustrated in FIG. 5 which shows the condition of the cap assembly when it has been rotated to a partially open position with its retaining lugs 16 adjacent the safety stops 71 of the filler neck. As the primary seal 31 is broken, the resulting pressure on the underside of seal member 41 applies an upward force to the radiator cap so that a much greater force will be required to overcome the safety stops until that pressure is relieved through vent pipe. Moreover, the stiffness of the expander clip 52 may be such that the sealing bead 49 is forced outwardly against the filler neck with sufficient force to hold the radiator cap in position against a quite large radiator pressure even if the cap is inadvertently rotated to the lift off position before the radiator has been properly vented.

FIG. 6 illustrates a modification to the sealing member 41 by which it is possible to eliminate the metal support plate 48. In this case the outer rim flange 46 of sealing member 41 is provided with a pair of concentric annular ribs 81 which are compressed against the under face of the radiator cap when it is screwed down onto the filler neck thereby to clamp the sealing groove 53 firmly against the rim of the filler neck.

Although the moulded sealing member 41 can be produced very cheaply and can simply be installed in place of the conventional flat annular sealing member in previous constructions, it greatly improves the efficiency of coolant recovery and also decreases the danger of blow-off on cap removal. However, the illustrated construction has been advanced by way of example only and it is to be understood that the invention is not limited to the details of this particular construction and that many modifications and variations will fall within the scope of the appended claims.

We claim:

1. A radiator cap assembly for fitting to a radiator filler neck having a tubular side wall and an internally projecting, upwardly facing, annular ledge positioned at the bottom of the side wall and surrounding a filler opening, said assembly comprising:

a cap to fit over the upper end of the filler neck;

an annular first seal element;

seal mounting means mounting said first annular seal element from the cap so as to engage the ledge of the filler neck when the cap is fitted to the filler neck and including biasing means to load the sealing member against the ledge so as to form a primary seal; and a second seal element having a cylindrical skirt portion extending away from the cap so as to project within the side wall of the filler neck, an annular flange portion projecting outwardly from the cap end of the skirt portion, a first annular seal surface on the annular flange portion to engage the rim of the filler neck at the upper end of said side wall and a second annular seal surface on said skirt portion to engage the inner peripheral surface of the side wall of the filler neck and thereby form a circumferential seal around that wall when the cap is fitted to the filler neck.

2. A radiator cap assembly as claimed in claim 1, wherein said second annular seal surface of the second seal element is defined by an outwardly projecting circumferential bead on said skirt portion of that element.

3. A radiator cap assembly as claimed in claim 2, wherein said first annular seal surface of the second seal element is defined by a groove in the face of the flange portion adjacent the junction between the flange portion and the skirt portion.

4. A radiator cap assembly as claimed in claim 1, wherein said second seal element includes a disc portion projecting inwardly from the cap end of the skirt portion and said biasing means acts to clamp that disc portion upwardly when the cap is fitted to the filler neck.

5. A radiator cap assembly as claimed in claim 1, wherein the mounting means for the first annular seal element comprises a structure which is loaded by said biasing means away from the cap and is fitted with said first seal element, said structure defining a valve passage normally closed by a valve member biased toward the cap but openable by movement of the valve member away from the cap.

6. The combination of a radiator filler neck having a tubular side wall and an internally projecting, upwardly facing, annular ledge positioned at the bottom of the side wall and surrounding a filler opening and a radiator cap assembly comprising:

a cap to fit over the upper end of the filler neck;

an annular first seal element;

seal mounting means mounting said first annular seal element from the cap so as to engage the ledge of the filler neck when the cap is fitted to the filler neck and including biasing means to load the sealing member against the ledge so as to form a primary seal; and a second seal element having a cylindrical skirt portion extending away from the cap so as to project within the side wall of the filler neck, an annular flange portion projecting outwardly from the cap end of the skirt portion, a first annular seal surface on the annular flange portion to engage the rim of the filler neck at the upper end of said side wall and a second annular seal surface on said skirt portion to engage the inner peripheral surface of the side wall of the filler neck and thereby form a circumferential seal around that wall when the cap is fitted to the filler neck.

7. The combination claimed in claim 6, wherein said second annular seal surface of the second seal element is defined by an outwardly projecting circumferential bead on said skirt portion of that element.

8. The combination claimed in claim 7, wherein said first annular seal surface of the second seal element is defined by a groove in the face of the flange portion adjacent the junction between the flange portion and the skirt portion.

9. The combination claimed in claim 6, wherein said second seal element includes a disc portion projecting inwardly from the cap end of the skirt portion and said biasing means acts to clamp that disc portion upwardly when the cap is fitted to the filler neck.

10. The combination claimed in claim 6, wherein said filler neck has a radiator coolant venting duct extending from a port in the side wall of the filler neck effective, in use of the apparatus, to vent hot coolant which might escape through the primary seal and wherein the second annular seal surface of said second seal element is disposed so as to form said circumferential seal above the level of the vent port.

11. The combination claimed in claim 10, wherein the mounting means for the first annular seal element comprises an annular structure which is loaded by said biasing means away from the cap and is fitted with said first seal element and which carries a central one-way valve operable, in use of the apparatus, by suction generated in the radiator to permit flow of coolant through said annular structure but to seal against a reverse flow of pressurized coolant.

* * * * *